United States Patent [19]

Falk

[11] 3,964,946

[45] June 22, 1976

[54] PROCESS FOR MOUNTING PHOTOGRAPHS TO SIMULATE AN OIL PAINTING

[76] Inventor: Eugene H. Falk, P.O. Box 1188, Monterey, Calif. 93940

[22] Filed: Jan. 31, 1975

[21] Appl. No.: 546,038

[52] U.S. Cl. ..... 156/59; 156/230; 156/254; 156/309; 156/322

[51] Int. Cl.[2] ..... B44C 3/02

[58] Field of Search ..... 156/59, 230, 234, 254, 156/344, 322, 309

[56] References Cited

UNITED STATES PATENTS

| | | | |
|---|---|---|---|
| 615,026 | 11/1898 | Hulbert | 156/59 |
| 3,589,955 | 6/1971 | Edwards | 156/59 |
| 3,772,106 | 11/1973 | Giorgi | 156/59 |

*Primary Examiner*—Edward G. Whitby
*Attorney, Agent, or Firm*—Gerald L. Moore

[57] ABSTRACT

An oil painting is simulated by gluing a photograph onto a textured surface, rolling the photograph with a nubby roller to force portions thereof into the voids of the textured surface and sealing the photographic surface thereafter in a manner to simulate an artist's brush strokes.

9 Claims, 8 Drawing Figures

PROCESS FOR MOUNTING PHOTOGRAPHS TO SIMULATE AN OIL PAINTING

BACKGROUND OF THE INVENTION

In the past, many efforts have been made to mount photographs in a manner to simulate oil paintings. Obviously the reason for such endeavor is to enhance the photograph by giving it some type of textured surface such that the casual observer may see it as an actual oil painting. While attempts along these lines at times have been fairly successful, in general the processes have been sufficiently complicated to require elaborate and sometimes expensive apparatus such as photo-mounting presses and the like which the ordinary person does not own. In addition, such processes have required that the photograph be printed on special paper before the mounting can be accomplished. It is the object of this invention to provide a process for mounting a standard photograph in a relatively quick, simple and economical manner.

SUMMARY OF THE INVENTION

A process for mounting a photograph or other printed image to simulate an oil painting comprising the steps of removing the backing from the photograph, gluing the photograph onto a planar textured surface, rolling the surface of the photograph with a nubby resilient roller so as to press the photograph into the voids of the textured surface, thereafter sealing the photographic surface with a material which dries to form a transparent seal and brushing onto the surface a transparent material preferably by simulating brush marks representative of the photograph.

DESCRIPTION OF THE INVENTION

Figure 2:
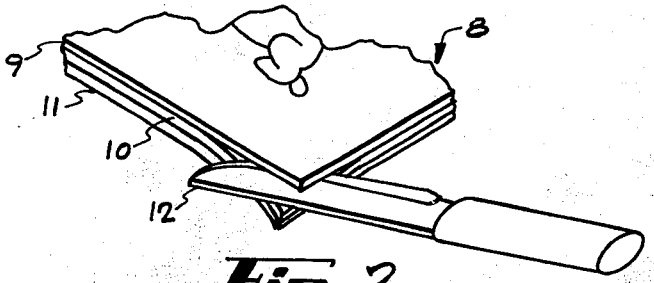
FIG. 2 shows the initiation of the removal of the image sheet from the backing prior to mounting.
Figure 3:
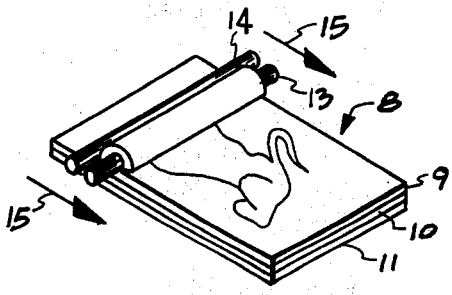
FIG. 3 shows the step of removing the image sheet from the backing.
Figure 5:
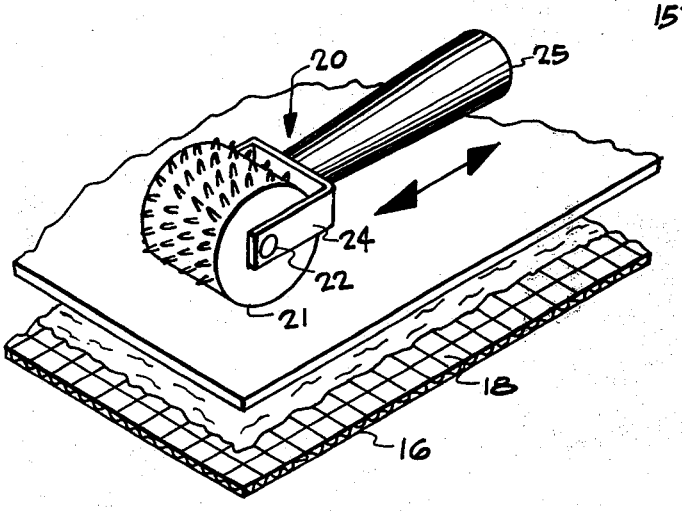
FIG. 5 shows the photograph in position on the textured surface and use of the resilient nubby roller for pressing the sheet onto the textured surface.
Figure 6:
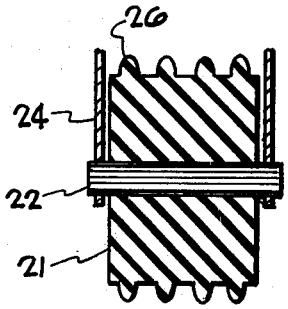
FIG. 6 is a cross-sectional view of the nubby roller.
Figure 7:
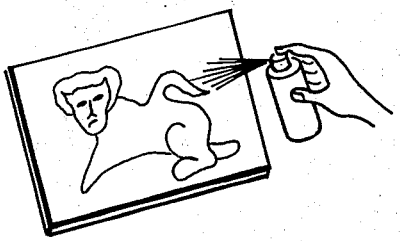
FIG. 7 shows the application of a sealing material over the mounted image sheet.
Figure 8:
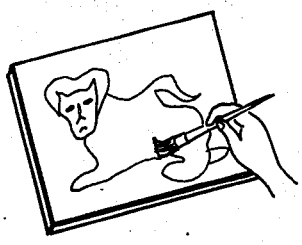
FIG. 8 shows the application of the transparent material in a manner to represent an artist's brush marks.

As indicated before, the invention involves a process for mounting a photograph or other image bearing sheet in a manner to simulate an oil painting. In the example to be described a photograph 8 (FIG. 2) is mounted in accordance with the present invention. In the usual instance, the photograph, whether it is a color image or not, is usually printed on layered sheets of plastic-coated paper cemented together. For instance, as illustrated in FIGS. 2 and 3, the image bearing sheet 9 is usually mounted on a thin stiff backing sheet 10 which can be separated therefrom by stripping the sheets apart. While it is preferable that this step be accomplished, it is not absolutely necessary. However, it should be kept in mind that a thinner photo sheet can be caused to conform better with a textured backing. Also, another plastic-coated sheet 11 will usually be cemented to the other side of the backing sheet 10.

One suitable method of removing the image sheet 9 from the stiffer backing sheet 10 is shown in FIGS. 2 and 3. A sharp knife 12 is used to separate one edge of the top image sheet 9 carrying the photographic emulsion from the backing sheet 10. Thereafter the separated image sheet edge is wrapped around a first roller 13 as shown in FIG. 3. A second roller 14 may be placed on the backing sheet 10 behind and parallel to the first roller 13. Then with the hands (not shown), palm open and flat, gently roll both rollers in the direction of the arrows 15 away from the separated sheet edges. The roller 13 will lift the image sheet 9 from the backing sheet as the top sheet is rolled therearound while the roller 14 holds the backing sheet down. Even better results can be obtained at times if after the edge of the image sheet is separated from the backing sheet, the exposed edge of the backing sheet is taped to a flat surface and the image sheet edge is taped to the roller 13.

Figure 1:
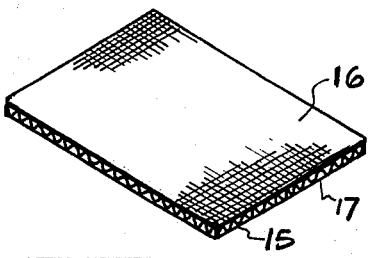
FIG. 1 illustrates a planar textured surface on which the photograph can be mounted.

To simulate an oil painting, the image must be mounted in a manner to provide a textured surface, preferably similar to the canvas on which most oil paintings are accomplished. For this purpose the textured board 15 (FIG. 1) is provided. As can be seen, a fabric cloth 16 is glued onto a hard board backing 17 in a suitable manner. There is available in art stores such boards already fabricated in the manner described, or one can simply glue burlap or other cloth material onto a hard board backing. Such a suitable hard board may be Masonite or other material. In addition, the textured board can be such materials as Masonite which are provided with a textured surface formed in the board itself. The choice depends upon the type of textured surface desired in the finished product.

For mounting the photograph image sheet onto the textured backing a glue is spread on one or both surfaces which are to be joined. In other words, the glue is either spread onto the textured side of the backing material or onto the back of an image sheet. The preferred method is to spread the glue on both surfaces to assure complete coverage and a good bonding therebetween. One type of glue suitable for this purpose is called Scotch Photo Mount, trademark of 3-M Company, which can be purchased in most art supply stores.

Figure 4:
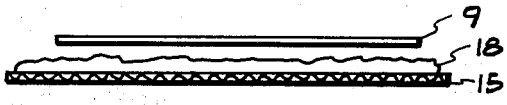
FIG. 4 is a cross-sectional view showing the textured surface, the image sheet and the glue therebetween.

After applying the glue, the photograph sheet is mounted onto the textured backing as illustrated in FIG. 4. As an alternative, the backing board can be heated prior to the mounting of the photograph. Preferably the board is heated for a period of three to five minutes in an atmosphere of 275° to 300° fahrenheit. The heating of the board will result in a heat transfer from the board to the photograph sheet 9 thereby making the sheet more resilient and pliable so that it will conform better to the textured surface.

After the sheet is mounted on the textured surface a nubby roller 20 is used to cause conformation of the photograph to the textured surface. The roller 21 preferably is made of rubber or other resilient material, is cylindrical in configuration and preferably on the order of ¾ to 1½ inches in diameter and ¼ to 2 inches in length. Passing through the center of the roller is a shaft 22 which fits into a U-shaped bracket 24 fixed to a handle 25. Thus by grasping the handle with the hand and pushing the roller forward across the photographic surface while pressing downward on the handle a series of resilient projections or nubs 26 on the roller surface will be pushed tightly against the photograph to cause it to be depressed inward into the voids of the textured material 16 mounted on the backing board 17. By use of the nubby roller which is resilient, the photograph will not be pressed so hard as to cause it to break or tear at those points where it extends into the textured surface yet a good conformation of the photograph to the textured surface will be obtained. Preferably this step is achieved with some speed because it is desirable that the photograph be pressed tightly to the textured surface while that surface is warmed above room temperature to cause the heat to transfer to the photograph. Because of the normal photographic material becoming more pliable as it is warmed it will conform more closely to the textured surface to be held there by the setting of the contact glue placed therebetween.

It should be remembered that the narrower the roller, the more pounds per square inch of pressure is applied to the photographic sheet with the same downward force on the handle 25 and therefore the better the photograph can be forced to conform to the textured backing. After the rolling process is completed, a clear sealing lacquer preferably is applied to the photograph surface which upon drying will seal the surface for excluding moisture and dirt from the photograph. The clear lacquer liquid can be applied to the surface in any suitable manner such as with a brush or by spraying to accomplish this sealing process.

Following the drying of the seal coating, it may be desirable to apply also a texture material which upon drying will be transparent but which can be maneuvered with a brush or palette knife to simulate brush marks. One example of such a texture material is Acrylic Polymer Emulsion Gel Medium. As an alternative, an antique coloring can be applied over the simulated oil painting formed by the process as heretofore described which antique material can be colored to enhance the photograph. One example of a suitable antique material for this purpose is a mixture of artists oil paints thinned with turpentine. This antique effect is accomplished by applying the material over the total photograph or at least over those areas desired to be antiqued with a brush or cheesecloth until the surface is completely covered. Thereafter by selective removal of the material with a paper towel by rubbing the towel over the photograph surface with a light circular motion, a desired effect can be obtained giving the finished product the desired antique color.

The invention claims:

1. A process for mounting a photograph or other printed image to simulate an oil painting comprising the steps of:

providing a textured surface having small voids therein;

fixing the photograph face up to the textured surface by spreading glue on one or both the photograph or the surface and pressing the photograph onto the surface;

rolling the photograph with a resilient roller having resilient projections thereon of a diameter sufficiently small to at least partially fit within the textured surface voids and press the adjacent portions of the photograph therein; and applying a transparent sealing material over the photograph which dries to form a seal for the photograph.

2. A process for mounting a photograph as defined in claim 1 including the step of utilizing a photograph comprising an image bearing thin sheet mounted on a stiff backing sheet and from the image sheet prior to fixing the image sheet to the textured surface.

3. A process for mounting a photograph as defined in claim 1 including the step of heating the photograph or textured surface immediately prior to fixing the photograph to the surface so the photograph will be heated and more pliable.

4. A process for mounting a photograph as defined in claim 2 including the step of applying a clear transparent texture material over the photograph after the sealing material is applied and dried, said textured material being spread in a manner to represent brush marks on the photograph surface.

5. A process for mounting a photograph as defined in claim 4 including the step of applying an antique finish over the clear transparent material after the transparent material dries.

6. A process for mounting a photograph as defined in claim 1 wherein the planar textured surface comprises a hard planar board with a burlap cloth glued to the surface.

7. A process for mounting a photograph as defined in claim 2 including the step of removing the backing sheet from the image sheet by separating the sheet edges, wrapping the image sheet separated edge around an elongated roller laying on the image sheet surface and rolling the roller in a direction away from the separated edge thereby rolling the image sheet around the roller.

8. A process for mounting a photograph as defined in claim 7 including the step of taping the separated edge of the backing sheet to a flat surface before rolling the roller thereacross.

9. A process for mounting a photograph as defined in claim 8 including the providing of a second roller, placing the second roller on the separated edge of the backing sheet and rolling the second roller with the first roller such that the second roller holds down the backing sheet while the image sheet is being separated therefrom.

* * * * *